US005722324A

United States Patent [19]

Nishiwaki et al.

[11] Patent Number: 5,722,324

[45] Date of Patent: Mar. 3, 1998

[54] INK TROUGH APPARATUS FOR A PRINTING PRESS

[75] Inventors: Hiroshi Nishiwaki; Toshiharu Fujiwara; Kazushi Hatanaka; Nobuyuki Baba, all of Osaka, Japan

[73] Assignee: Technoroll Co., Ltd., Izumi, Japan

[21] Appl. No.: 732,678

[22] Filed: Oct. 15, 1996

[30] Foreign Application Priority Data

Oct. 14, 1995 [JP] Japan ..... 7-292206
Mar. 18, 1996 [JP] Japan ..... 8-090441

[51] Int. Cl.[6] ..... B41F 1/46

[52] U.S. Cl. ..... 101/363; 118/278; 164/91; 164/137; 101/367; 101/483

[58] Field of Search ..... 101/363, 365, 101/366, 367, 350.1, 350.4, 352.1, 483; 118/218, 224, 225, 226, 227, 228; 164/91, 137; 193/37

[56] References Cited

U.S. PATENT DOCUMENTS

| | | | |
|---|---|---|---|
| 449,110 | 3/1891 | Dolphin | 101/367 |
| 2,078,628 | 4/1937 | Crafts | 101/363 |
| 2,655,103 | 10/1953 | Hirschey | 101/366 |
| 3,308,754 | 3/1967 | Munn | 101/366 |
| 4,026,210 | 5/1977 | Merzagora | 101/367 |
| 4,147,126 | 4/1979 | Riggs | 118/227 |
| 4,165,688 | 8/1979 | Leanna | 101/363 |
| 4,328,748 | 5/1982 | Schramm | 101/365 |
| 4,455,938 | 6/1984 | Loudon | 101/148 |
| 4,603,633 | 8/1986 | Schubert | 101/366 |
| 4,987,831 | 1/1991 | Weder | 101/363 |
| 5,265,535 | 11/1993 | Isowa et al. | 101/366 |
| 5,433,308 | 7/1995 | Gagnon | 193/37 |
| 5,596,927 | 1/1997 | Maurer et al. | 101/363 |

FOREIGN PATENT DOCUMENTS

| | | |
|---|---|---|
| 6143542 | 11/1992 | Japan . |
| 6198225 | 7/1994 | Japan . |

*Primary Examiner*—Eugene H. Eickholt
*Attorney, Agent, or Firm*—Darby & Darby

[57] ABSTRACT

An ink trough for a printing press is formed between two rollers and two side members on opposite ends of the rollers. The rollers can be operated independently for ink removal and cleaning purposes.

9 Claims, 4 Drawing Sheets

INK TROUGH APPARATUS FOR A PRINTING PRESS

BACKGROUND OF THE INVENTION

1. Field of the Invention

The present invention relates to a printing press that includes a cleaning device.

2. Discussion of the Related Art

An ink trough of a conventional printing press is formed by contacting a metering blade to the surface of a fountain roller.

When the ink is changed, the ink trough is washed according to the following steps:

(1) stopping rotation of all rollers of the printing press;

(2) removing ink from the ink trough with a spatula;

(3) wiping off ink residues from the ink trough with a duster; and (4) driving the printing press manually so that ink residues can be wiped off from the printing press with a duster that is fully absorbed with a washing liquid.

In such an ink changing process:

(1) the work for cleaning the printing press is inefficient since it is prosecuted manually;

(2) workers are in danger of getting their fingers caught between the rollers, together with a duster, because the work is done by actuating the printing press manually;

(3) the ink that is wiped off and stuck on the duster results in a loss; and (4) the hands of the workers become so dirty that they cannot be easily washed clean.

To free a worker from such dangerous and dirty work, the inventor of the present invention invented and disclosed a printing press that includes a cleaning device in Japanese Laid-Open Nos. 6-143542 and 6-198225.

The cleaning device is comprised of an ink distribution tube that supplies ink to a fountain roller, a liquid distribution tube that supplies a washing liquid to a transfer roller and a metal doctor blade for withdrawing an ink residue and a waste fluid.

When the ink is changed, the ink distribution tube is set out of operation and the liquid distribution tube is set into operation, causing the washing liquid to be transferred over the whole of the printing press.

During this process, the doctor blade is also set into engagement against the roller causing an ink residue, a waste fluid and a dirt to be removed from the printing press so that the ink changing process is automatically completed in a relatively short time with the cleaning device.

Despite these advances, the application of a metal doctor blade causes damage to the surface of the roller.

Of course, the use of a rubber doctor blade does not cause such damage, but easily causes a gap between the doctor blade and the roller due to abrasion of the edge of the doctor blade.

Additionally, a printing press that includes a cleaning device still must remove the ink that remains in the trough by scooping the ink out with a spatula or the like in advance of the operation of the liquid distribution tube and the doctor blade.

Thus, the prior art attempts have not perfectly solved the problems in the ink changing process.

SUMMARY OF THE INVENTION

It is an object of the present invention to remove ink from an ink trough automatically during the ink changing process.

It is a further object of the present invention to effectively withdraw dirt from ink residues and washing liquid with a metal doctor blade by transferring the washing liquid all over the printing press.

It is still a further object of the present invention to prevent damage the surface of the roller by a metal doctor blade that is used for cleaning during the ink changing process.

In accordance with a preferred embodiment of the present invention, an ink trough as is formed as a channel by arranging a fountain roller and a trough roller parallel with respect to each other wherein both ends of the channel are dammed up with seal members.

Each seal member is comprised of a crescent-shaped and curved surface (e.g., a partial radially inwardly facing cylindrical surface), and a pair of inside facing (e.g., planar surfaces that face the axial ends of the rollers) surfaces 3 (see FIG. 7).

The crescent-shaped and curved surfaces are shaped so that the seal member contacts closely the cylindrical surfaces of the fountain roller and the trough roller, respectively, when the seal member is placed over these two rollers.

The inside surfaces meet the crescent-shaped and curved surface at right angles, so that the seal member contacts closely to both rims of the fountain roller and trough roller because both cylindrical surfaces of fountain roller and trough roller, respectively, meet the outsides of these rollers at right angles.

The inside surfaces of the seal member extends downward over the central line between the axes of adjacent rollers.

A doctor blade is applied to the trough roller. A trough roller drive means is operated to actuate the trough roller independently from a drive means for the fountain roller, and also is operated to allow the trough roller to stop independently from a drive means for the fountain roller.

The diameter of the fountain roller may be different from the diameter of the trough roller.

The trough roller may be the end roller of a roller train consisting of a plurality of parallel adjacent rollers wherein each roller is contiguous with the adjacent roller or rollers.

In one embodiment, a trough roller which is located at the end of the roller train adjacent the fountain roller, should be brought into engagement with the fountain roller as a metering roller. Doctor blade is applied to a second trough roller which is located at the opposite end of the roller train, the roller train connected with (against) the fountain roller.

The trough roller drive means consists of a plurality of gears fixed to shafts extending from the outside of each trough roller, and one or more intermediate gears, which are in engagement with every adjacent gear to transfer rotation to the adjacent trough rollers, and a motor for actuating the roller train.

Seal members can be formed in accordance with the following steps:

first, an inside plate is formed having crescent-shaped apertures which mirror the cylindrical surface shape of adjacent rollers in the channel so that the crescent-shaped apertures closely contact the cylindrical surfaces of adjacent rollers;

second, an outside plate is supported at a distance from the inside plate, and the outside surfaces of the rollers;

third, the space formed between the outside plate and the inside plate and the outside surfaces of the rollers is closed by end plates so that a cast frame is formed by these plates; and fourth, a fluid material is poured into the enclosure formed by the cast frame to form the seal members by casting.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE INVENTION

Figure 1:
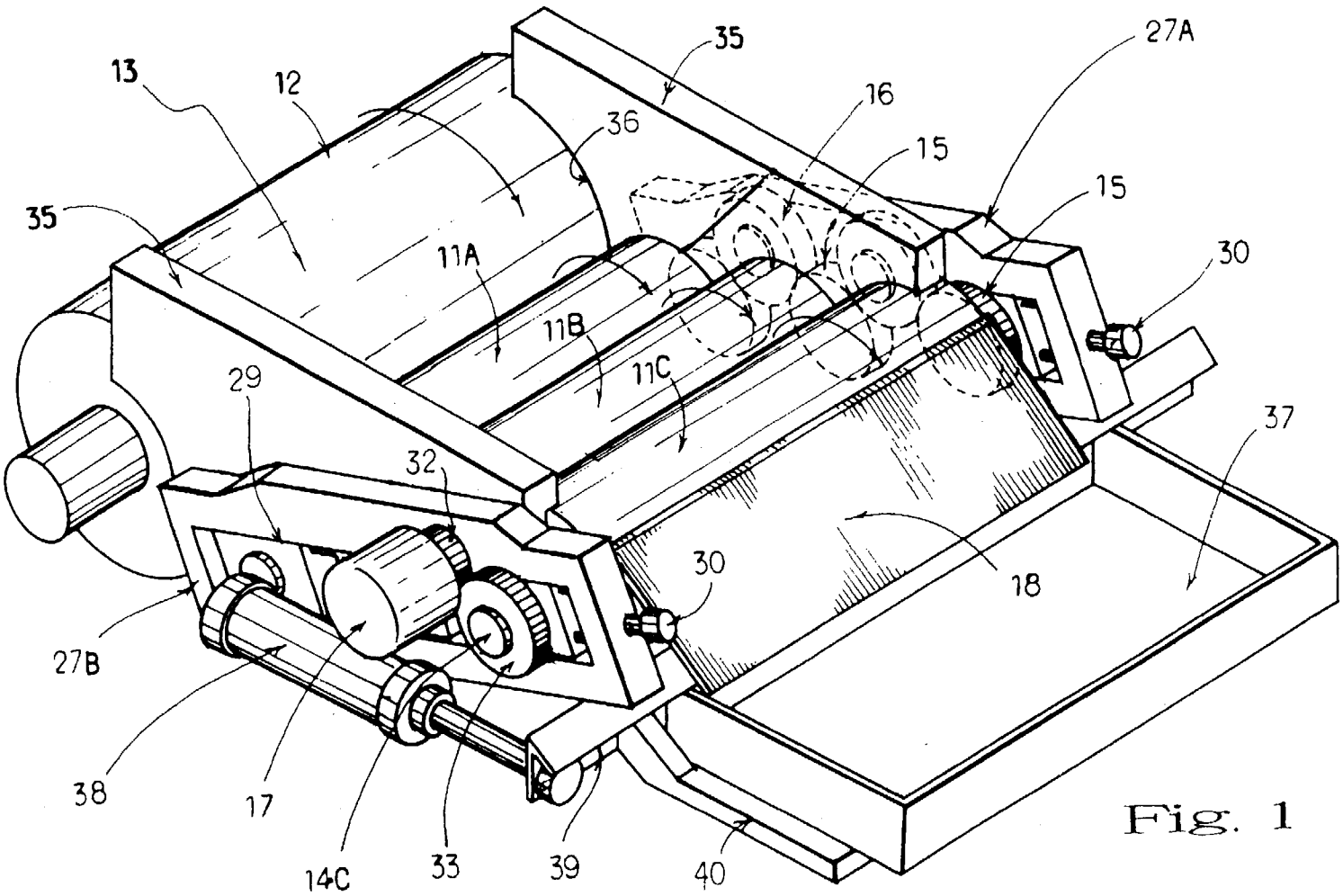
FIG. 1 is a perspective view of an ink trough apparatus according to the present invention.
Figure 2:
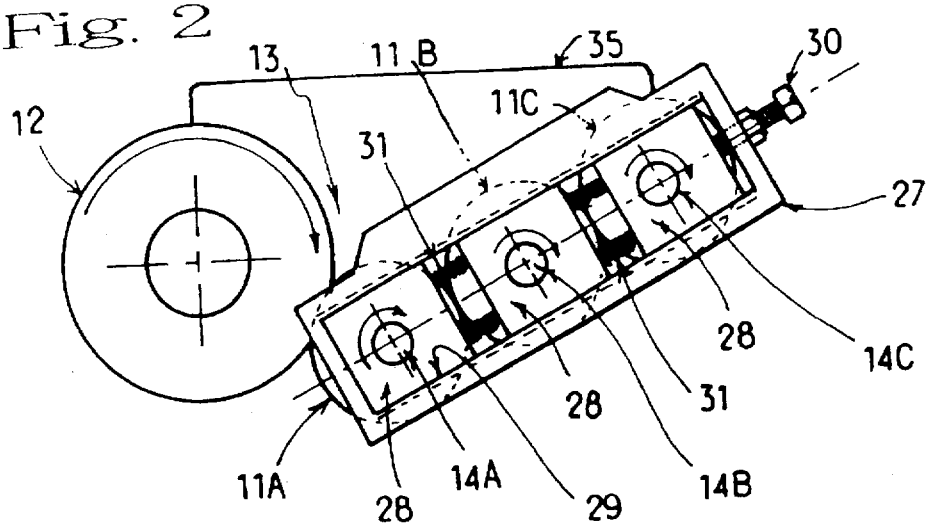
FIG. 2 is a side view of an ink trough apparatus according to the present invention.
Figure 3:
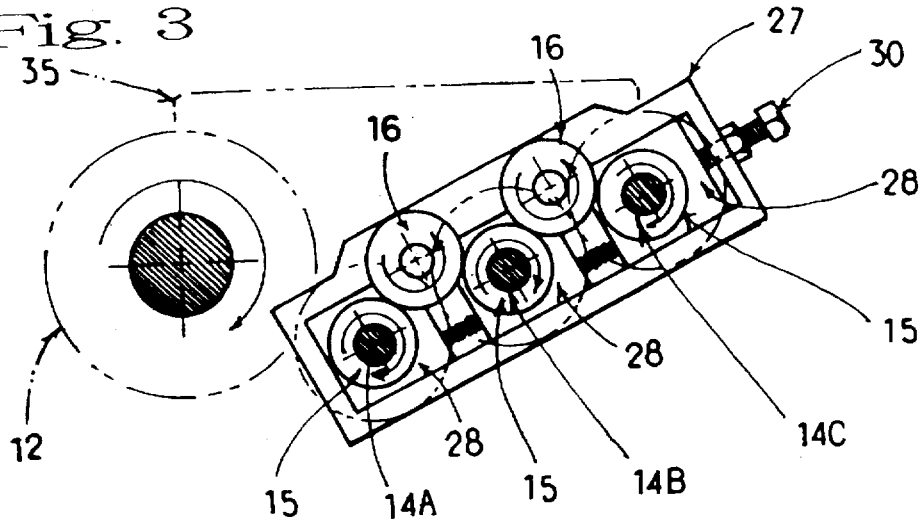
FIG. 3 is a sectional side view of an ink trough apparatus according to the present invention.

Referring now to FIGS. 1–3, a preferred embodiment of an ink trough apparatus, which is comprised of a fountain roller 12, a roller train, a motor 17, and a doctor blade 18 is illustrated.

The roller train is formed by arranging three trough rollers 11A, 11B, 11C in parallel, wherein adjacent trough rollers 11A and 11B, 11B and 11C are contiguous to each other.

Trough roller 11A which is located at the end of the roller train, is brought into engagement with the fountain roller 12 and acts as a metering roller.

A gap between trough roller 11A and the fountain roller 12 is adjustable by moving the roller train (i.e., rollers 11A, 11B and 11C) toward and away from the fountain roller 12.

Frame 27 supports the trough rollers 11A, 11B, 11C. Frame 27 has a relatively slender rectangular opening. The upper surface and lower surface 29 of the opening form rails. Three square-shape bearings 28, each of which supports a shaft 14A, 14B, 14C of the trough rollers 11A, 11B, 11C, respectively, fit into the opening. Bearings 28 are slidably received along rail. In other words, bearings 28 are selectively movable in the direction of the length of the opening.

The pressure between every adjacent two trough rollers 11A–11B, 11B–11C is adjustable with the use of a screw 30 that is set on the end of the frame 27.

The gauge between the bearings can be enlarged by a spring 31 that is placed between them and then an interstice is to bear between every adjacent trough roller when the screw is loosened.

A gear 15 is fixed to each shaft 14A, 14B, 14C of the trough rollers. An intermediate gear 16 is fixed to frame 27 and is in engagement with the adjacent two gears 15, 15.

Another gear 33 is fixed to the opposite end of shaft 14C and engages with a gear 32, which is fixed to the shaft of the motor 17 that is mounted on the frame 27. Thus, the three trough rollers 11A, 11B, 11C rotate in synchrony according to the actuation of the motor 17.

When the trough rollers 11A, 11B, 11C rotate, the ink 34 stored in the ink trough moves from the fountain roller side 12 toward the end trough roller side 11C where the ink is to overflow.

A seal member 35 dams up an outside of the ink trough, adjacent to the axial ends of the rollers 12, 11A–11C.

The bottom side 36 of the seal member 35 is formed in a crescent-shaped recessed wall so that seal member 35 closely contacts the outer cylindrical surfaces of the adjacent rollers when it is mounted over them.

A doctor blade 18 is used to remove the ink away from the trough roller 11C. Doctor blade 18 is fixed on the supporting member 39, which is driven by pneumatic piston cylinder 38 to cause blade 18 to reciprocate toward and away from trough roller 11C.

A reservoir 37 is removably mounted on arm 40, which extends from supporting member 39.

Figure 4:
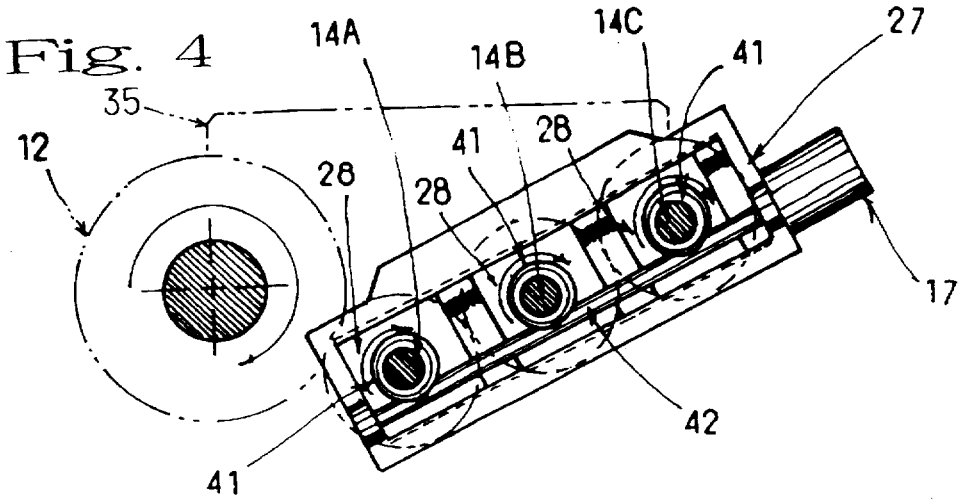
FIG. 4 is a sectional side view of an ink trough apparatus according to the present invention.
Figure 5:
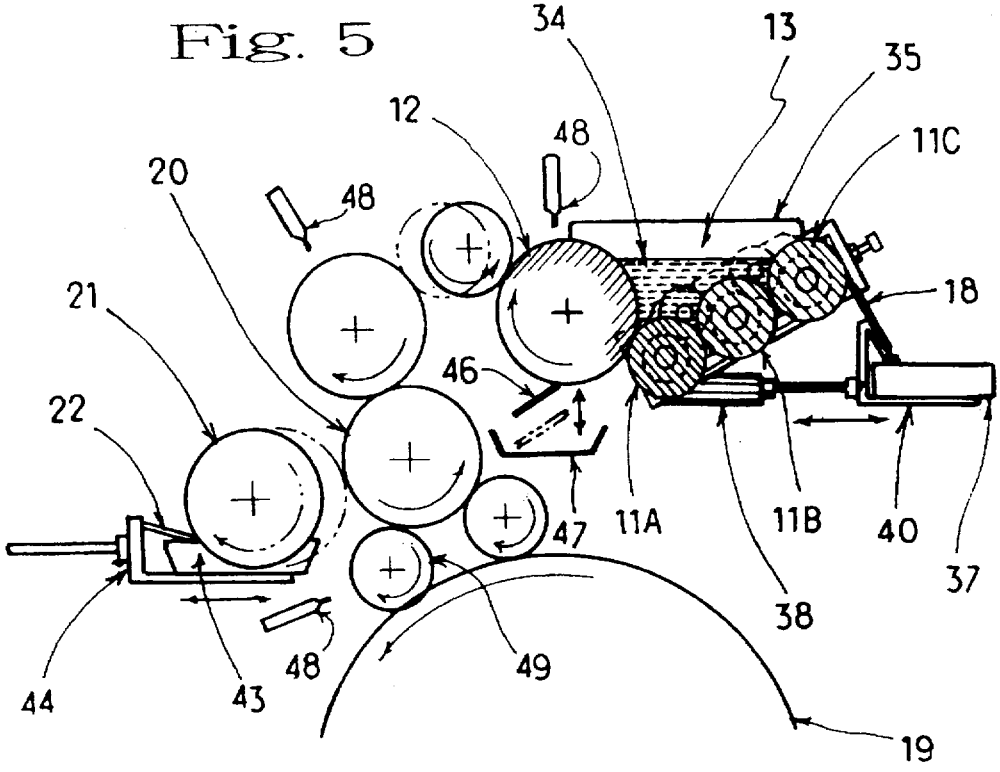
FIG. 5 is a diagrammatic side view of a printing press according to the present invention.
Figure 6:
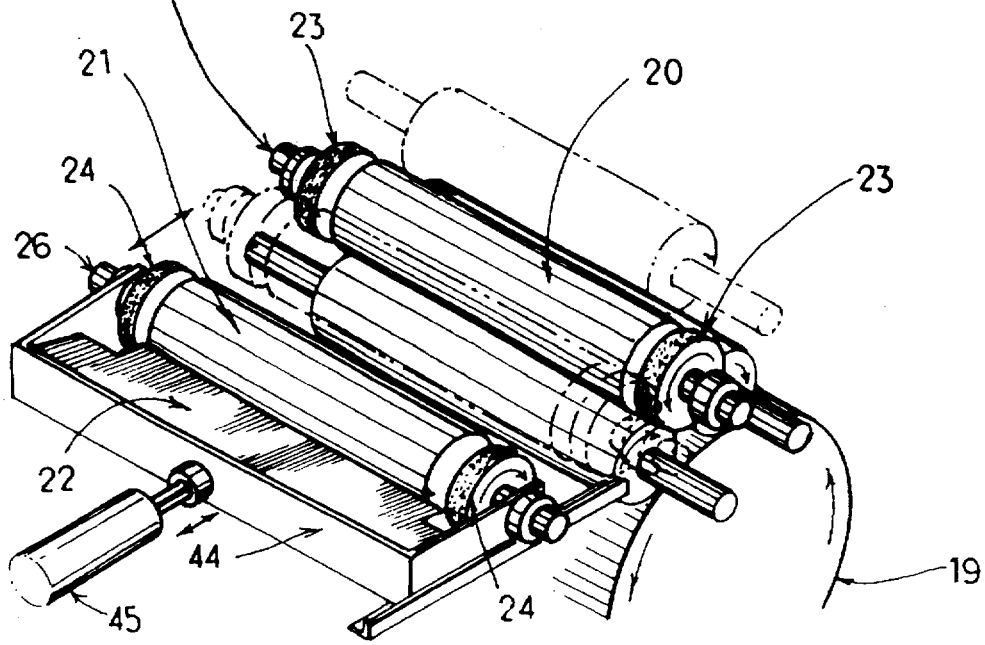
FIG. 6 is a perspective view showing the transfer roller and the washing roller shown in FIG. 5.

Another embodiment of the trough roller drive means is illustrated in FIG. 4. A worm wheel 41 is fixed to each shaft of the trough roller 11 and engages with a worm gear 42, which is supported on the frame 27 and is driven by motor 17. Thus, the three trough rollers 11A, 11B, 11C rotate in synchrony (and of course, stop in synchrony) according to the actuation of motor 17.

In referring to the above-mentioned embodiments shown in FIGS. 1–3 and 4, it will be clear to those skilled in the art that the trough roller drive means can be achieved in various ways, for example, by affixing a sheave or rope pulley in place of the spur gear or the worm wheel and by driving the pulley with a V-belt.

The trough roller drive means can also be achieved by fixing a spur gear to the shaft of the trough rollers 11A, 11B, 11C and by driving the spur gears with a timing belt or a chain belt, which is preferably of the silent type.

Further, it is also possible to apply a friction roller instead of gears 15, 16.

However, it is preferable to compose the trough roller means by applying a spur gear train 15, 16 as shown in FIGS. 1 and 3 to form the trough roller drive means in a compact shape.

In all the above-mentioned embodiments, motor 17 for driving the trough roller 11 is applied independently from a motor that drives the fountain roller 12 and other rollers 19, 20, 49. However, if a clutch were applied between the trough roller 11 and the fountain roller 12 and the other rollers 19, 20, 49, the trough roller 11 could be driven independently of the fountain roller 12 and the other roller 19, 20, 49 with the motor for driving them.

Trough roller 11 is preferably driven independently of fountain roller 12 because trough roller 11 is generally held stationary and in engagement with fountain roller 12 as a metering roller during operation of the printing press. Additionally, trough roller 12 must be rotated to remove ink residue from the ink trough 13 during the ink changing period.

A second doctor blade 22 is applied together with washing roller 21 which is driven toward and away from transfer roller 20 by contacting the surface of the washing roller 21. Thus, doctor blade 22 does not directly contact the surface of the transfer roller 20.

Friction rollers 23, 24 are affixed to the shafts 25, 26 of the transfer roller 20 and the washing roller 21, respectively.

When the washing roller 21 is pushed forward to contact transfer roller 20, friction rollers 23, 24 engage each other and the rotation of transfer roller 20 is transmitted to washing roller 21. Ink residue, waste fluid and dirt transfer from transfer roller 20 to washing roller 21, and is removed from washing roller 21 by doctor blade 22.

A reservoir 43 is provided below washing roller 21. Washing roller 21 is mounted on a supporting frame 44 together with reservoir 43 and doctor blade 22.

Air cylinder 45 is provided for reciprocally driving washing roller 21, together with the reservoir 43 and the doctor blade 22, toward and away from transfer roller 20.

A third doctor blade 46 is provided for engaging fountain roller 12 also by reciprocally driving toward and away from fountain roller 12.

Reservoir 47 is provided below doctor blade 46.

Distribution tube 48 is provided to supply a washing liquid independently to fountain roller 12, ink-form roller 49 and other rollers as desired.

In the embodiments shown in the drawings, reservoirs 37 and 43 are moved together and in coordination with doctor blades 18 and 22, respectively. These reservoirs 37 and 43 may however be fixed, that is, without moving relative to doctor blades 18 and 22, in a position to catch and accumulate ink residue, waste fluid, and dirt for removal.

Figure 7:
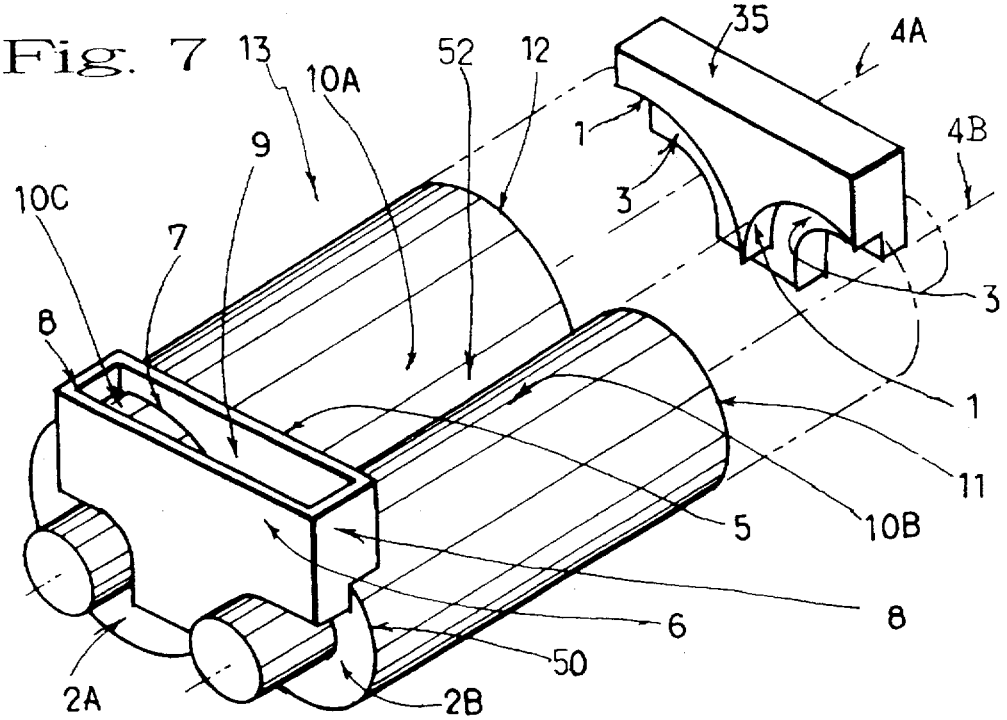
FIG. 7 is a perspective view of an ink trough apparatus according to the present invention.

FIG. 7 illustrates the process for forming the seal member 35. Seal member 35 is formed according to the following steps:

(1) first, an inside plate 5 is provided having crescent-shaped apertures 7, which generally mirror the cylindrical surfaces 10A, 10B of adjacent rollers 12 and 11 in channel 52. The edges of crescent-shaped apertures 7 are in close contact with cylindrical surfaces 10A and 10B of adjacent rollers 12 and 11.

(2) second, outside plate 6 is provided in a spaced apart relationship from inside plate 5 and outside surfaces 2A and 2B (i.e., axial and surfaces) of rollers 12 and 11.

(3) third, the space formed between outside plate 6 and inside plate 5 and outside surfaces 2A and 2B of the rollers 12 and 11 is enclosed with end plates 8 so that a cast frame 9 is formed about a cast cavity that is, in part, formed by plates 5, 6 and 8; and (4) fourth, a fluid material is poured into the cast cavity of the cast frame 9 to form seal members 35 by casting.

The following compounds may, for example, be used as a fluid casting material: (1) a thermoplastic resin compound that is fluid at conventional temperatures, which is composed of thermoplastic resin, such as, for example, ethylene-vinylacetate resin, polyvinyl-chloride resin, alkyd resin and the like, organic or inorganic solvents, plasticizers, coagulants, vulcanizing agents, dispersants, fillers and the like;

(2) a thermosetting resin compound that is fluid at conventional temperatures, which is composed of thermosetting resin, such as, for example, epoxy resin, unsaturated-polyester resin and the like, organic or inorganic solvents, plasticizers, coagulants, vulcanizing agents, dispersants, fillers and the like;

(3) a plastic resin powder compound, which is composed of low melting resin, such as, for example, polypropylene resin, polyethylene resin, polystyrene resin and the like, which may be melted by heat;

(4) a metal powder compound, which is composed of low melting metal, such as, for example, solder, lead and the like which may be melted by heat; or (5) an inorganic compound, which causes a hydration and turns into solids composed of (cements, gypsums, fillers or sand aggregates) and the like.

In the preferred embodiment, a dispersion of ethylene-vinylacetate resin, polyvinylchloride resin, stylene-butadiene latex, acrylonitrile-butadiene-stylene latex, natural latex and the like are mixed into the inorganic compound.

It is also preferable to mix a fiber, such as, for example, glass fibers, carbon fibers, metal fibers and the like, and a heavy filler, such as, for example, sulfate of barium, nickel, stainless steel, lead, or ceramic into the resin compounds, the resin powder compounds and the inorganic compounds.

It is preferable to cover portions of cylindrical surfaces 10 and the outside surfaces 2 of the rollers, which are exposed to the cast cavity, with a coating film such as, for example, oil, wax or other lubricant, or with paper, plastic film, cloth or the like. The coating film prevents bonding of the casting material to the rollers 11 and 12, so that molded seal member 35 may be easily removed from rollers 11 and 12.

It is also preferable to provide a means for reinforcement in the cast cavity of the cast frame 9, and to mold the seal member 35 about the reinforcement like a reinforced concrete article.

Of course, a bolt, nut or other supporting member for affixing seal member 35 to frame 27 may be provided within the cast cavity of cast frame 9, so that it is cast into the body of seal member 35.

Seal member 35 may be formed together with the cast frame 9, without releasing cast frame 9 from seal member 35 after casting, or seal member 35 may be released from cast frame 9. Cast frame 9 may be integrally formed as a molded single piece plastic extrusion comprising inside plate 5, outside plate 6 and end plates 8.

Also, the supporting members for affixing the seal member 35 to frame 27 may be integrally formed together with cast frame 9 as one body, or may be separate pieces affixed to cast frame 9 after molding.

In accordance with the present invention, during the ink changing period, ink residue, waste fluid, and dirt are automatically removed from the ink trough 13 by trough roller 11, so that the dangerous manual work of cleaning is dispensed with.

The printing press is not significantly increased in size or bulk by addition of the cleaning device since the ink trough itself serves as the cleaning device.

The application of doctor blade 22 does not injure or damage the surface of transfer roller 20, since the doctor blade 22 is not in direct engagement with transfer roller 20 but is in engagement indirectly with it through washing roller 21, the rotation of which is transmitted from transfer roller 20 by means of friction rollers 23 and 24 in the ink changing period. Thus, the withdrawing operation and the cleaning operation become efficient by using solid metal doctor blade.

Seal member 35 is formed by injecting a fluid casting material into the cast cavity through an opening in the upper surface of cast frame 9. The casting material is exposed not only to cylindrical surfaces 10, 10 but also outside surfaces 2, 2 of adjacent rollers 11, 12, which are arranged and adjusted to store the ink between them.

If the axes of adjacent rollers and/or the surfaces of the adjacent rollers are not precisely in position, two pairs of surfaces of the seal members and rollers, crescent-shaped curved surface 1 of the seal member against outside surface 10 of the rollers and inside surface 3 of the seal members against outside surface 2 of the rollers, respectively, precisely contact (i.e, touch) without forming a gap between them.

Figure 8:
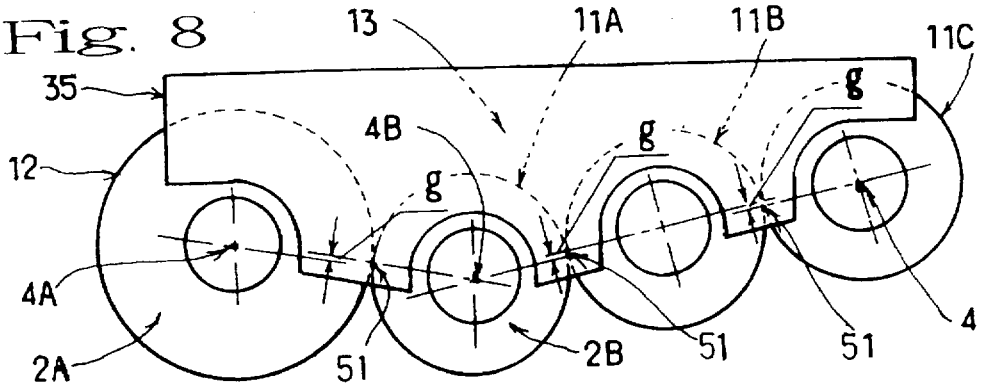
FIG. 8 is a side view of an ink trough apparatus according to the present invention.
Figure 9:
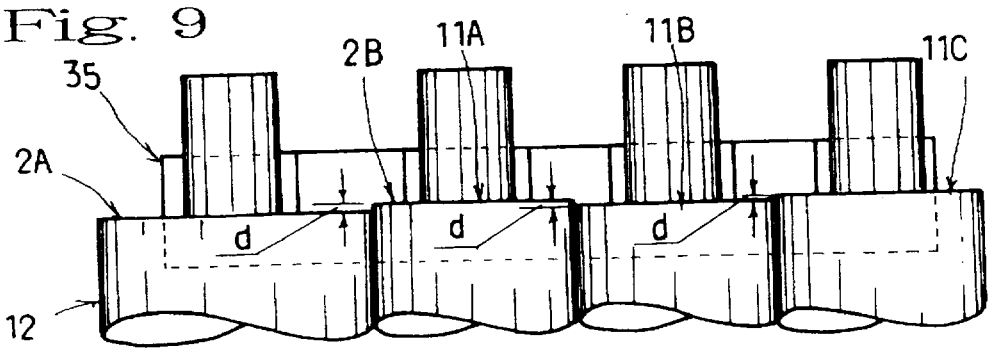
FIG. 9 is a partial bottom view of an ink trough apparatus according to the present invention.

Leakage of the ink and the waste fluid is not caused by a discrepancy as shown in FIG. 8, for example, by dimension "g" between the axes of rollers, or as shown in FIG. 9, for example, by dimension "d" the difference of alignment of the outside surface of the rollers in the vertical plane. The dimension "g" and dimension "d" must be considered in the design for the ink trough, especially where a diameter of fountain roller 12 differs from a diameter of trough roller 11 as in accordance with the present invention. However, since leakage does not result from the greater dimensional tolerances allowed by the design of the present invention, the ink trough can be constructed rapidly without significantly considering the precise positions for the alignment of the rollers. Rim 50 of the roller of ink trough 13 (i.e., where cylindrical surface 10 and outside surface 2 meet at right angles) contacts and is covered within the crescent-shaped aperture 1 of seal member 35.

Ink and washing liquid that are stuck on the outside surface 2 of rollers 10 during operation generally moves toward rim 50 due to the effect of centrifugal force.

Thus, even if the interstice bear between the seal member and the roller caused by the friction, the ink and the washing liquid could not leak out from between them and could not be scattered due to the centrifugal effect.

To prevent leakage at the line of tangency 51 (see FIG. 8) where two adjacent rollers are in contact with each other, it is preferred to extend the inside surface 3 of the seal member 35 downward beyond the central line between the axes 4A and 4B of the adjacent rollers.

Cylindrical surfaces 10A and 10B of adjacent rollers, which are mounted on frame 27 parallel and contiguous to each other, precisely and closely contact each other without any space between them, since a roller is generally finished by grading its cylindrical surface 10 by contacting a cutter on its surface and by moving the cutter in parallel to axis 4 of the roller while rotating the roller.

On the other hand, the outside surfaces 2A and 2B of two adjacent contacting rollers, may not always be aligned in a fixed vertical plane relationship due to measuring inconsistencies in the length of rollers which are common in the process of cutting roller bodies. However, even if a difference in vertical plane relationship as shown, for example, by dimension "d", between the outside surfaces *2a, 2b* of adjacent rollers of the ink trough occurs due to the discordance of the lengths of the rollers, such difference "d" does not cause leakage in the ink trough due to the design of seal member 35.

As mentioned above, in accordance with the present invention (1) a cleaning process of the printing press in the ink changing period can be performed perfectly automatically, (2) an operator for the printing press is set free from a dangerous and dirty cleaning work, (3) an ink changing can be achieved in a short time so that (4) the rate of operation will be increased.

What we claimed is:

1. An ink trough apparatus for a printing press comprising:

an ink trough being defined by a fountain roller forming a front end of said ink trough and a trough roller forming a rear end of said ink trough, said fountain and said trough rollers being in sealing parallel contact, and seal members forming opposite sides of said ink trough, said seal members being proximal to and in sealing contact with respective opposite ends of said rollers; and a trough roller drive means for actuating the trough roller;

a fountain roller drive means for actuating the fountain roller, said trough roller drive means being actuated independently with respect to said fountain roller drive means.

2. An ink trough apparatus for a printing press as defined in claim 1, wherein a doctor blade is applied to the trough roller.

3. An ink trough apparatus for a printing press as defined in claim 1, wherein the trough roller is comprised of a multiple roller roller train, wherein the multiple trough rollers are arranged in parallel, adjacent trough rollers of said multiple trough rollers are contiguous to each other, and at least one of said trough rollers is located adjacent to and in engagement with the fountain roller as a metering roller.

4. An ink trough apparatus for a printing press as defined in claim 3, wherein the trough roller drive means comprises a plurality of drive gears affixed to shafts extending from the outside of each trough roller, at least one intermediate gear connects adjacent drive gears said intermediate gears for transmitting a rotation between the adjacent trough rollers, and a motor for driving said drive gears to actuate said roller train.

5. An ink trough apparatus for a printing press as defined in claim 3, wherein the fountain roller is located at one end of the roller train and a doctor blade is applied to a trough roller located at the opposite end of the roller train.

6. An ink trough apparatus for a printing press as defined in claim 1, wherein the seal member comprises cylindrical surfaces formed so as to closely contact the cylindrical surfaces of the fountain roller and the trough roller and inside surfaces that intersect the cylindrical surfaces at right angles that are formed so as to closely contact the edge portions of the fountain roller and trough roller, where both cylindrical surface of the fountain roller and trough roller respectively intersect the axial ends of the fountain roller and trough roller at right angles.

7. An ink trough apparatus for printing press as defined in claim 1, wherein a diameter of the fountain roller differs from a diameter of the trough roller.

8. An ink trough apparatus for printing press as defined in claim 6, wherein the inside surface of the seal member extends downward over the central line between the axes of the adjacent rollers.

9. A method for making an ink trough apparatus for a printing press, said trough comprising a channel formed between two rollers that are disposed in parallel and a seal member for damming both ends of the channel, said method comprising the steps of:

(a) placing a cast frame over the axial ends of the rollers, (b) pouring a fluid material into a cast cavity of the cast frame so that said seal member is formed about portions of said axial ends of said rollers, wherein (i) said cast frame is composed of an inside plate, an outside plate, and an end plates, (ii) said inside plate has cylindrical-shaped apertures formed to closely approximate the shape of corresponding cylindrical surfaces of the adjacent rollers, (iii) said inside and outside plates being arranged in a spaced apart relationship and said plates being connected by the end plates at both ends, thereby forming a cast cavity, and wherein the outside plate is spaced from the axial ends of the rollers so that the casting cavity extends beyond the axial ends of the rollers.

* * * * *